US008366061B2

(12) United States Patent
Rose et al.

(10) Patent No.: US 8,366,061 B2
(45) Date of Patent: Feb. 5, 2013

(54) PAINT CONTAINER HOLDER

(75) Inventors: Joseph Lorney Rose, Pembroke (CA); Larry Steven Gagne, Pembroke (CA)

(73) Assignee: Innovative Technology Development, Ontario (CA)

( * ) Notice: Subject to any disclaimer, the term of this patent is extended or adjusted under 35 U.S.C. 154(b) by 776 days.

(21) Appl. No.: 11/995,604

(22) PCT Filed: Jul. 14, 2006

(86) PCT No.: PCT/CA2006/001155
§ 371 (c)(1),
(2), (4) Date: Aug. 20, 2008

(87) PCT Pub. No.: WO2007/006156
PCT Pub. Date: Jan. 18, 2007

(65) Prior Publication Data

US 2009/0173849 A1 Jul. 9, 2009

Related U.S. Application Data

(60) Provisional application No. 60/698,956, filed on Jul. 14, 2005.

(51) Int. Cl.
*A47G 23/02* (2006.01)

(52) U.S. Cl. ..... 248/146; 248/211; 15/257.06; 220/570

(58) Field of Classification Search ..... 220/570, 220/756, 763, 772; 248/148, 210, 211; D32/53.1; 15/257.06
See application file for complete search history.

(56) References Cited

U.S. PATENT DOCUMENTS

| | | | | | |
|---|---|---|---|---|---|
| 614,091 | A | * | 11/1898 | Doherty | 248/136 |
| 717,336 | A | * | 12/1902 | Brown | 248/136 |
| 1,593,043 | A | * | 7/1926 | Stroecker | 248/210 |
| 1,772,392 | A | * | 8/1930 | Milton | 248/210 |
| 2,524,875 | A | * | 10/1950 | Beaver | 248/211 |
| 2,932,544 | A | * | 4/1960 | Lambert | 297/163 |
| 3,091,793 | A | * | 6/1963 | Bentley, Jr. | 15/257.06 |
| 3,474,996 | A | * | 10/1969 | Stamm | 248/210 |
| 3,641,616 | A | * | 2/1972 | Bonci | 15/257.06 |
| 3,731,840 | A | * | 5/1973 | Beutler et al. | 220/570 |
| 3,738,601 | A | * | 6/1973 | Gehringer | 248/210 |
| 3,814,364 | A | * | 6/1974 | Gargaro | 248/210 |
| 4,013,251 | A | * | 3/1977 | Cleveland | 248/210 |
| 4,023,702 | A | | 5/1977 | McKnight | |
| 4,085,877 | A | | 4/1978 | Hildebrand | |
| 4,205,411 | A | * | 6/1980 | Cupp et al. | 15/257.06 |
| 4,212,371 | A | * | 7/1980 | Gaviorno, Jr. | 182/121 |
| 4,695,023 | A | * | 9/1987 | McCafferty | 248/238 |
| 4,861,050 | A | | 8/1989 | Bergeron | |
| D312,158 | S | * | 11/1990 | Lund | D32/54 |
| 5,113,549 | A | | 5/1992 | Villiano | |
| 5,217,193 | A | | 6/1993 | Drucker | |
| 5,224,239 | A | * | 7/1993 | Cuthbert, Jr. | 15/347 |
| 5,228,159 | A | * | 7/1993 | Gurka | 7/105 |
| 5,232,187 | A | | 8/1993 | O'Farrell et al. | |
| D349,376 | S | * | 8/1994 | Hankey, Sr. | D32/53.1 |
| 5,400,916 | A | | 3/1995 | Weber | |

(Continued)

*Primary Examiner* — Terrell McKinnon
*Assistant Examiner* — Daniel J Breslin
(74) *Attorney, Agent, or Firm* — McDonnell Boehnen Hulbert & Berghoff LLP

(57) ABSTRACT

A holder for a paint container can be used on uneven surfaces. The holder comprises a support base. Pivotally coupled to the support base is at least one leg and/or a lifting member. The at least one leg is selectively positionable for fixing the angular orientation of the at least one leg relative to the paint container support base. The lifting member may be located to support a paint container across a lateral axis extending substantially above a combined center of gravity of the holder and the paint container.

19 Claims, 17 Drawing Sheets

U.S. PATENT DOCUMENTS

| | | | | |
|---|---|---|---|---|
| 5,429,205 | A | 7/1995 | Collins | |
| 5,511,753 | A | 4/1996 | Lage | |
| 5,785,003 | A * | 7/1998 | Jacobson et al. | 119/496 |
| 5,913,782 | A | 6/1999 | Monaco et al. | |
| 6,019,241 | A * | 2/2000 | Burns | 220/570 |
| 6,266,849 | B1 * | 7/2001 | Petit et al. | 16/425 |
| 6,341,666 | B1 | 1/2002 | Allen | |
| 6,352,135 | B1 | 3/2002 | Jones | |
| 6,354,643 | B1 * | 3/2002 | Podejko | 294/19.2 |
| 6,431,392 | B1 | 8/2002 | Eisenbeisz | |
| 6,443,260 | B1 | 9/2002 | Katz et al. | |
| 6,565,051 | B2 | 5/2003 | Vaglica | |
| 6,604,721 | B2 * | 8/2003 | Ahl et al. | 248/210 |
| 6,808,476 | B2 * | 10/2004 | Zagone | 482/80 |
| 6,898,825 | B1 * | 5/2005 | Charest | 24/16 PB |
| 2002/0027091 | A1 | 3/2002 | Brown | |

* cited by examiner

PAINT CONTAINER HOLDER

RELATED APPLICATION

This application claims the benefit of U.S. Provisional Application Ser. No. 60/698,956 herein incorporated by reference.

FIELD OF THE INVENTION

The present invention relates to a holder which can be used to hold a paint tray, paint can or other paint container, particularly on inclined surfaces, stairs or level surfaces, and which improves the stability and portability of the paint container.

BACKGROUND OF THE INVENTION

An example of a known paint tray carrier is described in U.S. Pat. No. 4,085,877 issued on Apr. 25, 1978 to Hildebrand (hereinafter "Hildebrand"). The paint tray carrier of Hildebrand has a horizontal handle and adjustable tubular members which allow the carrier to be adapted for use with paint trays of different sizes. The paint tray carrier of Hildebrand is limited to use on level surfaces.

Various apparatuses have been developed for holding paint containers on inclined surfaces, such as rooftops. An example of paint can holder for use on an inclined surface is described in U.S. Pat. No. 5,217,193 issued to Drucker on Jun. 8, 1993 (hereinafter "Drucker"). U.S. Pat. No. 5,913,782 issued to Monaco, et al. on Jun. 22, 1999 (hereinafter "Monaco, et al.") and U.S. Patent Publication No. US 2002/0027091 A1 of Brown published Mar. 7, 2002 (hereinafter "Brown") discloses respectively a rooftop platform and roof toolbox. Drucker shows a paint can holder having a tray and adjustable legs. The legs are adjustable by sliding the legs up and down through holes in the tray. Brown shows a rooftop toolbox having a central tray, a pair of support legs and a pair of adjustable pin assemblies. The pair of support legs are pivotably attached to the central tray and are adjustable by means of pin assemblies. Monaco, et al. discloses a platform for use on a roof. Foldable legs are provided on a table structure.

Various carriers for paint trays are also known. For example, U.S. Pat. No. 5,113,549 issued to M. J. Villiano on May 19, 1992 discloses a single upstanding arm which extends over a paint tray when in use and a coupler for coupling the arm to the tray.

All of these known assemblies have drawbacks. Bending is required by the painter while maintaining clear access to the paint. Furthermore, none of the known apparatuses allow use on level and inclined surfaces, as well as stairs.

SUMMARY OF THE INVENTION

According to a first broad aspect of the invention, there is provided a holder for a paint container, the holder comprising: a support base; at least one leg pivotally coupled to the support base at least a first pivot point and selectively positionable for fixing the angular orientation of the at least one leg relative to the support base; and a lifting member pivotally coupled to the support base at least a second pivot point.

According to a second broad aspect, there is provided a holder for a paint container, the paint container and holder having a combined centre of gravity, the holder comprising: a support base; a lifting member coupled to the support base at a point below the combined centre of gravity, the lifting member being located to support the paint container across a lateral axis extending substantially above the combined centre of gravity.

According to a third broad aspect of the present invention, there is provided a support for use on an uneven surface comprising: a support tray; at least one leg pivotally coupled to the support tray and selectively positionable for fixing the angular orientation of the at least one leg relative to the support tray; each leg comprising an arm portion pivotally connected to the support tray and a surface engaging portion extending at an angle from the arm portion; wherein, in use, the arm portion remains at or above a bottom surface of the support tray when the surface engaging portion engages the uneven surface.

According to another broad aspect, there is provided a holder for a paint container comprising: a support base; at least one leg pivotally coupled to the support base at least one pivot point and selectively positionable for fixing the angular orientation of the at least one leg relative to the paint container support base; and a lifting member pivotally coupled to the paint container support base at the at least one pivot point.

According to another broad aspect there is provided, a holder for a paint container, the paint container and holder having a combined center of gravity, the holder comprising: a support base; a lifting member coupled to the support base, the lifting member being located to support the paint container across a lateral axis extending substantially above the combined center of gravity.

According to yet another broad aspect, there is provided, a support for use on an uneven surface comprising: a support tray; at least one leg pivotally coupled to the support tray and selectively positionable for fixing the angular orientation of the at least one leg relative to the support tray; each leg comprising an arm portion pivotally connected to the support tray and a surface engaging portion extending at an angle from the arm portion; wherein, in use, the arm portion remaining above a bottom surface of the support tray when the surface engaging portion engages the uneven surface.

According to a further aspect of the present invention, there is provided a support adapted for use on stairs, the stairs having an upper stair and a lower stair, the support comprising: a support tray; at least one leg pivotally coupled to the support tray towards a supported end of the support tray and the at least one leg being selectively positionable for fixing free ends of the at least one leg relative to the support tray; the at least one leg being curved and sized such that when the support tray is placed on the upper stair, the at least one leg contacts the stairs only with the free ends on the lower stair.

According to still a further aspect of the present invention, there is provided a support adapted for use on at least two sizes of stairs, the stairs having an upper stair and a lower stair, the support comprising: a support tray; at least one leg pivotally coupled to the support tray and selectively positionable in at least two positions for fixing step engaging ends of the at least one leg relative to the support tray; the at least one leg being curved and sized such that when the support tray is placed on the upper stair, the at least one leg contacts the stairs only with the step engaging ends on the lower stair.

According to a further aspect of the present invention, there is provided a holder for a paint container comprising: a paint container support; at least one leg pivotally coupled to the paint container support and selectively positionable for fixing the angular orientation of the at least one leg relative to the paint container support; and a lifting member pivotally coupled to the paint container support and movable between a support position and a storage position independent of the at least one leg.

According to still another aspect of the present invention, there is provided a holder for a paint tray adapted for use with a paint roller, the holder comprising: a paint tray support having sides, a front and a rear; a lifting member coupled to at least one side at least one attachment point located towards the rear, the lifting member comprising at least one elongated member, wherein, when the lifting member is in an upright position, the at least one elongated member is angled rearwardly from the attachment point to substantially avoid interference with movement of a paint roller during use.

According to a further aspect of the present invention, there is provided a paint container assembly comprising: a paint container; at least one leg pivotally coupled to the paint container at least one pivot point and selectively positionable for fixing the angular orientation of the at least one leg relative to the paint container; and a lifting member pivotally coupled to the paint container at the at least one pivot point.

According to yet a further aspect of the present invention, there is provided a paint container assembly for use on an uneven surface comprising: a paint container; at least one leg pivotally coupled to the paint container and selectively positonable for fixing the angular orientation of the at least one leg relative to the paint container; each leg comprising an arm portion pivotally connected to the paint container and a surface engaging portion extending at an angle from the arm portion; wherein, in use, the arm portion remains above a bottom surface of the paint container when the surface engaging portion engages the uneven surface.

According to yet another aspect of the present invention, there is provided a paint container assembly adapted for use on stairs, the stairs having an upper stair and a lower stair, the assembly comprising: a paint container; at least one leg pivotally coupled to the paint container towards a supported end of the paint container and the at least one leg being selectively positionable for fixing free ends of the at least one leg relative to the paint container; the at least one leg being curved and sized such that when the paint container is placed on the upper stair, the at least one leg contacts the stairs only with the free ends on the lower stair.

According to still another aspect of the present invention, there is provided a paint container assembly adapted for use on at least two sizes of stairs, the stairs having an upper stair and a lower stair, the assembly comprising: a paint container; at least one leg pivotally coupled to the paint container and selectively positionable in at least two positions for fixing step engaging ends of the at least one leg relative to the paint container; the at least one leg being curved and sized such that when the paint container is placed on the upper stair, the at least one leg contacts the stairs only with the step engaging ends on the lower stair.

According to a further aspect of the present invention, there is provided a paint container assembly comprising: a paint container; at least one leg pivotally coupled to the paint container and selectively positionable for fixing the angular orientation of the at least one leg relative to the paint container; and a lifting member pivotally coupled to the paint container and movable between a support position and a storage position independent of the at least one leg.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
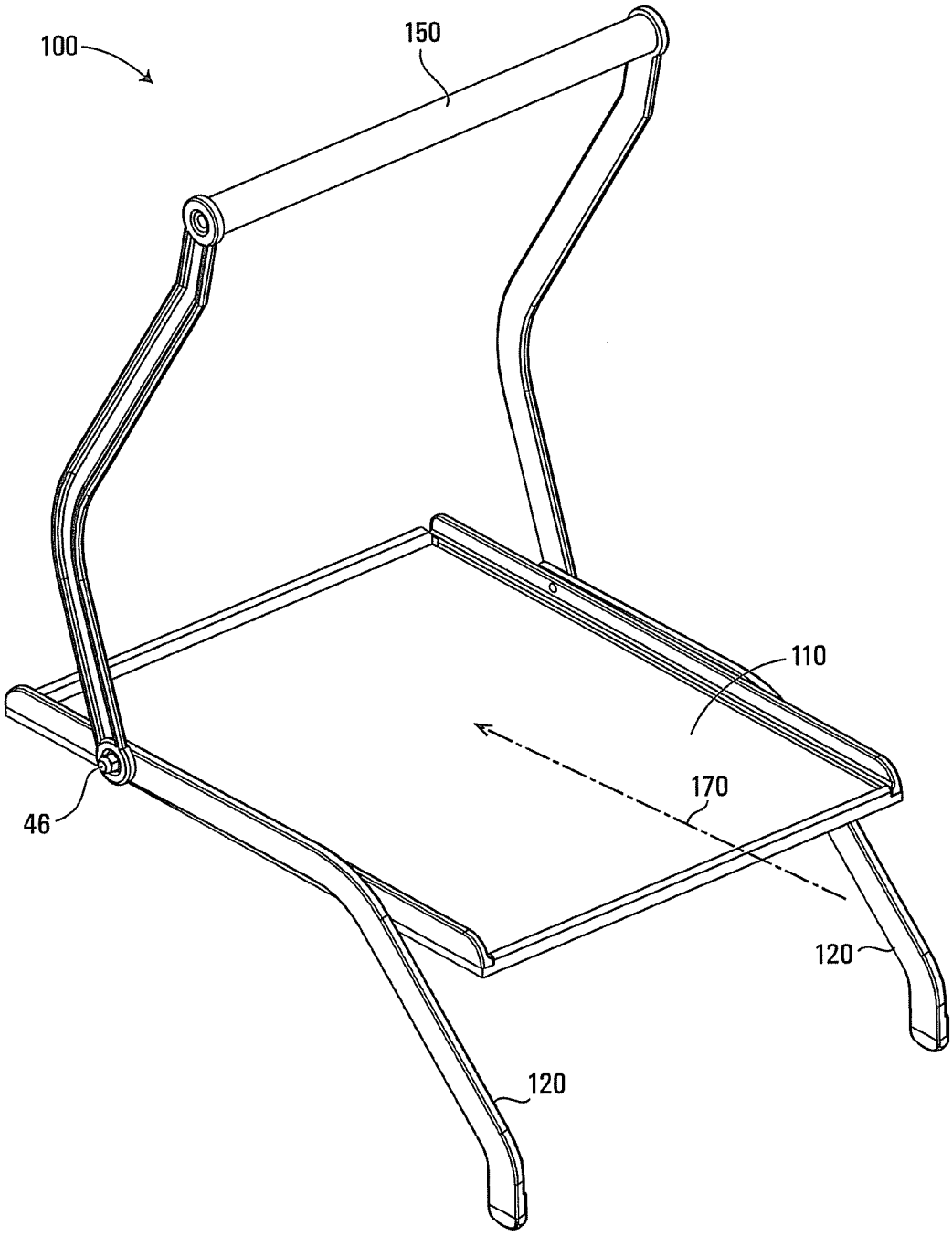
FIG. 1 is a perspective view of a holder according to one embodiment of the present invention.

Referring to FIG. 1, in one embodiment of the present invention a holder 100 for a paint container comprises a support base 110, at least one leg 120 (two shown), and a lifting member 150. The support base 110 can be a base adapted to receive a paint tray or a paint container, such as a paint can. Alternatively, the support base 110 can be a paint tray or a paint container of any sort. The at least one leg 120 is pivotally coupled to the support base 110 at least a first pivot point 140 and selectively positionable for fixing the angular orientation of the at least one leg relative to the paint container support base. Thus, the legs 120 can be adjusted to allow for the holder being placed on uneven surfaces. The lifting member 150 is also pivotally coupled to the support base. In the embodiment shown in FIG. 1, the lifting member 150 is coupled at the at least a first pivot point 140. In other embodiments, the lifting member 150 is coupled to the support base 110 at a second pivot point.

In some embodiments, the lifting member 150 is movable between a upright position and a folded position. In some embodiments, the lifting member 150 is moveable independent of the at least one leg 120. In still further embodiments, the at least one leg 120 is positionable at the upright position and the folded position in substantial alignment with the lifting the member. This last embodiment allows for compact storage and transport of the holder. For even more compact storage, a longitudinal axes of the lifting member 150 and the at least one leg 120 of one embodiment of the holder 100 are in substantial alignment with a longitudinal axis of the support base in the folded position.

The lifting member 150 of some embodiments comprises at least one longitudinally oriented member joined to a laterally oriented member and wherein the laterally oriented member extends substantially across the combined centre of gravity of the paint container and the support base 110. This ensures that the holder 100 remains stable when lifted.

In some embodiments, the at least one leg 120 comprises two legs pivotally coupled to opposite sides of the support base 110.

In a particular design, the at least one leg 120 and the lifting member 150 are curved away from a paint roller input direction 170 to substantially avoid interference with movement of a paint roller during painting.

Figure 2:
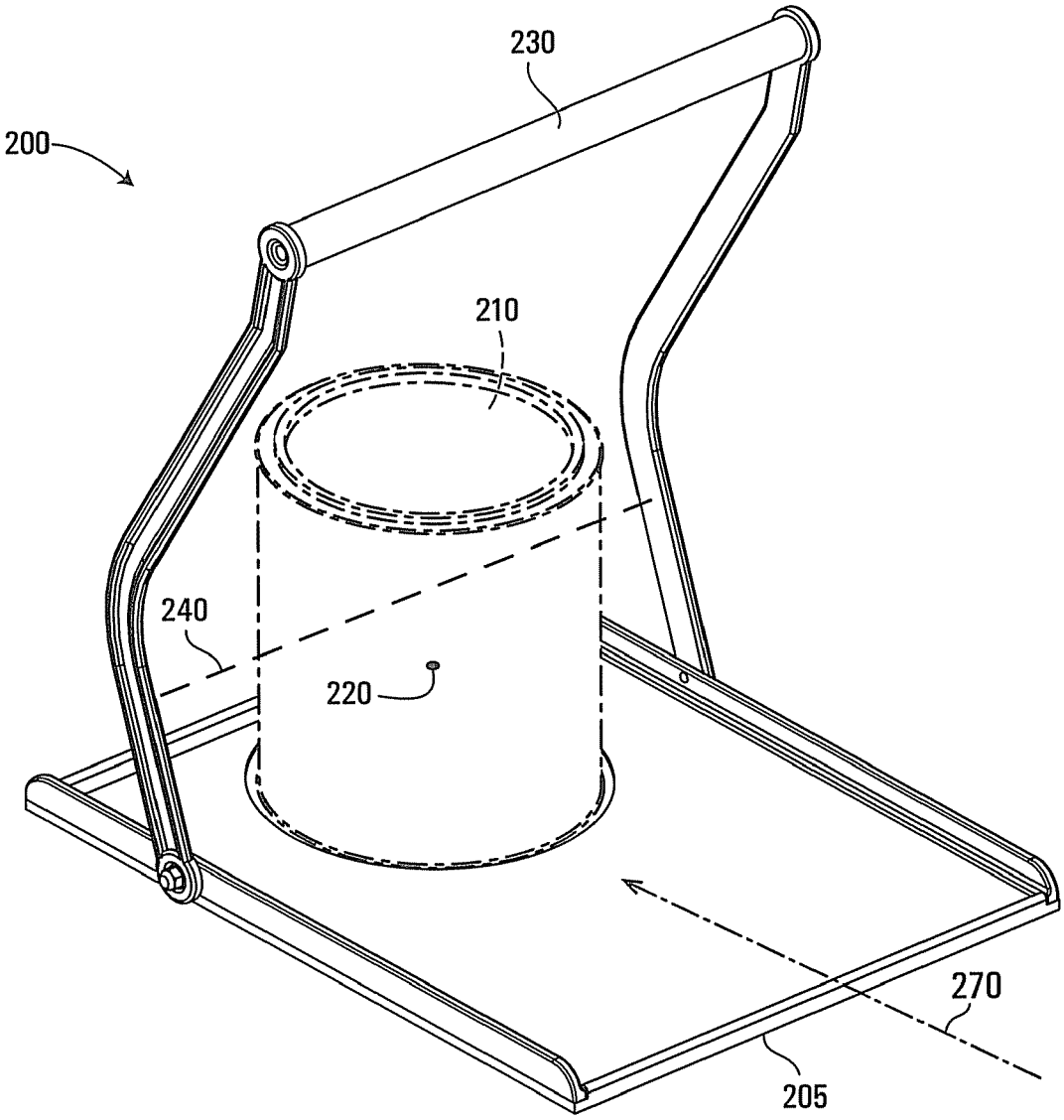
FIG. 2 is a perspective view of a holder according to one embodiment of the present invention.

Referring now to FIG. 2 a holder 200 for a paint container 210, according to an embodiment of the present invention, will now be described. In this embodiment, the paint container 210 and holder 200 have a combined centre of gravity 220. The holder 200 comprises a support base 205 and a lifting member 230 coupled to the support base 205 at a point below the combined centre of gravity. The lifting member 230 is located to support the paint container 210 across a lateral axis 240 extending substantially above the combined centre of gravity 220.

As with other embodiments, the lifting member 230 may be shaped to avoid interference with use of a paint roller when the lifting member is in an upright position. In some embodiments, the lifting member 230 comprises at least one vertically oriented member curved away from a paint roller entrance direction 270.

In some embodiments, the lifting member is moveable to a locked upright position and a folded position.

Furthermore, the lifting member 230 may be designed to be positionable in a folded position and to have a longitudinal axis of the lifting member is substantially co-directional with a longitudinal axis of the support base. In some embodiments, the lifting member 230 is pivotally coupled to the support base. In still further embodiments, the lifting member 230 is coupled to the support base 205 adjacent lateral sides of the paint container 210.

In some embodiments of the holder 200, the lifting member 230 comprises two longitudinally oriented arcuate members joined by a laterally oriented member. Additionally, the two longitudinally oriented arcuate members may be coupled to the paint container bottom support adjacent lateral sides of the paint container.

The support base 205, in some embodiments of the present invention, comprises a paint tray having sides, a front and a rear. The lifting member 230 of these embodiment is coupled to at least one side at least one attachment point located towards the rear. The lifting member 230 comprises at least one elongated member, such that, when the lifting member is in an upright position, the at least one elongated member is angled rearwardly from the attachment point to substantially avoid interference with movement of a paint roller during use.

Figure 3:
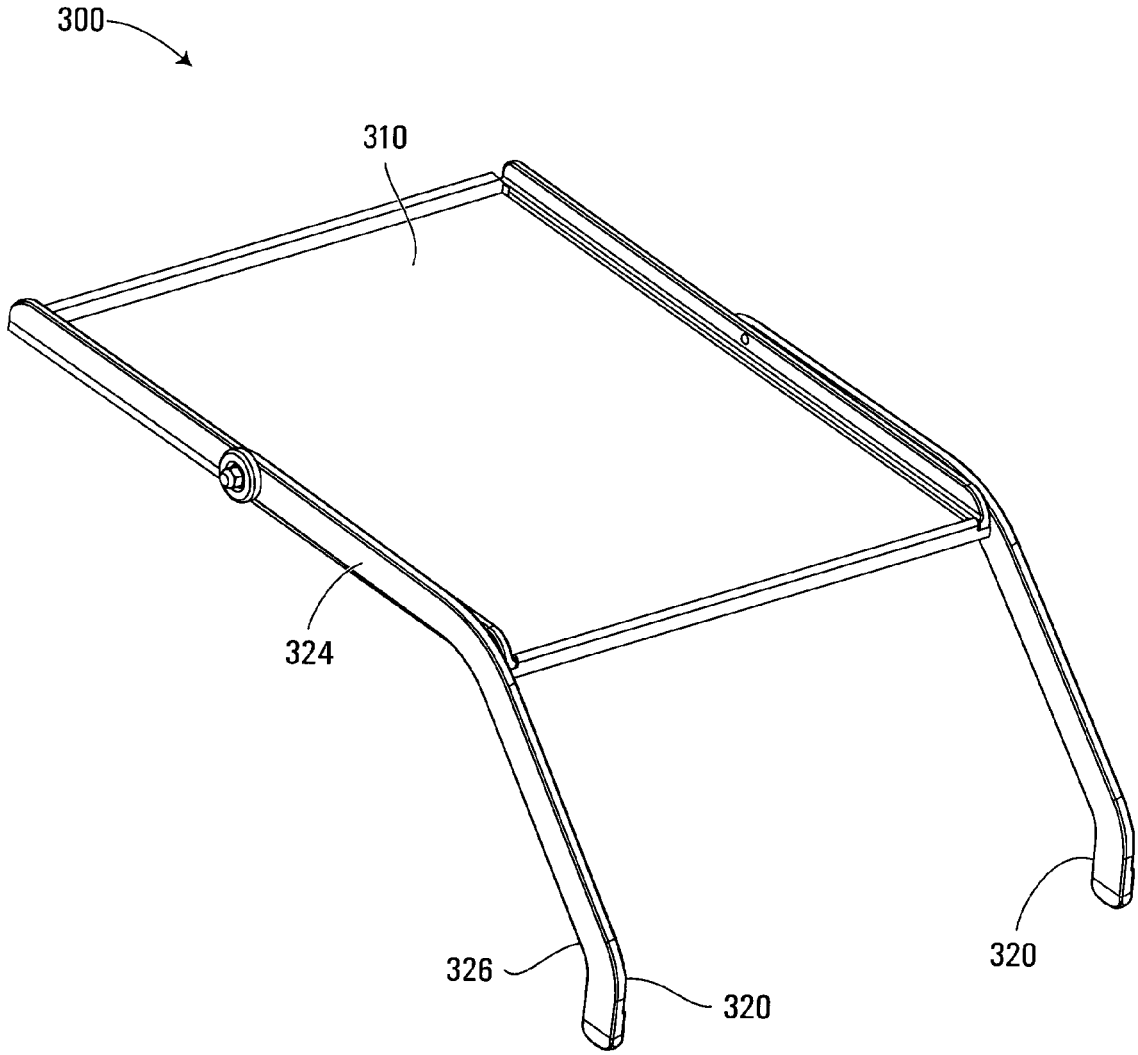
FIG. 3 is a perspective view of a holder according to one embodiment of the present invention.
Figure 4:
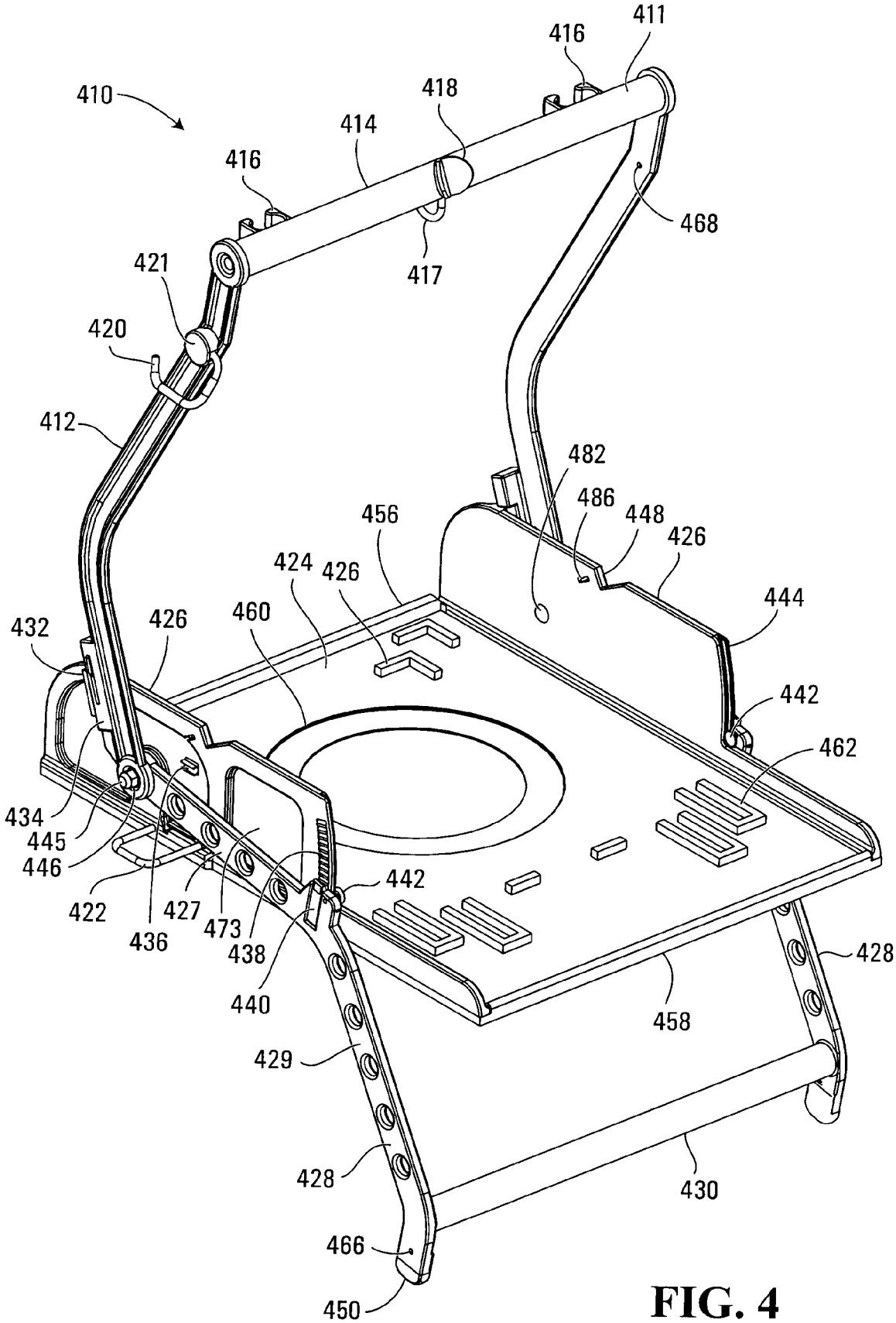
FIG. 4 is a perspective view of a holder with an arm in an upright position and legs in a lowered position for use on stairs or sloped surfaces according to an embodiment of the present invention.
Figure 5:
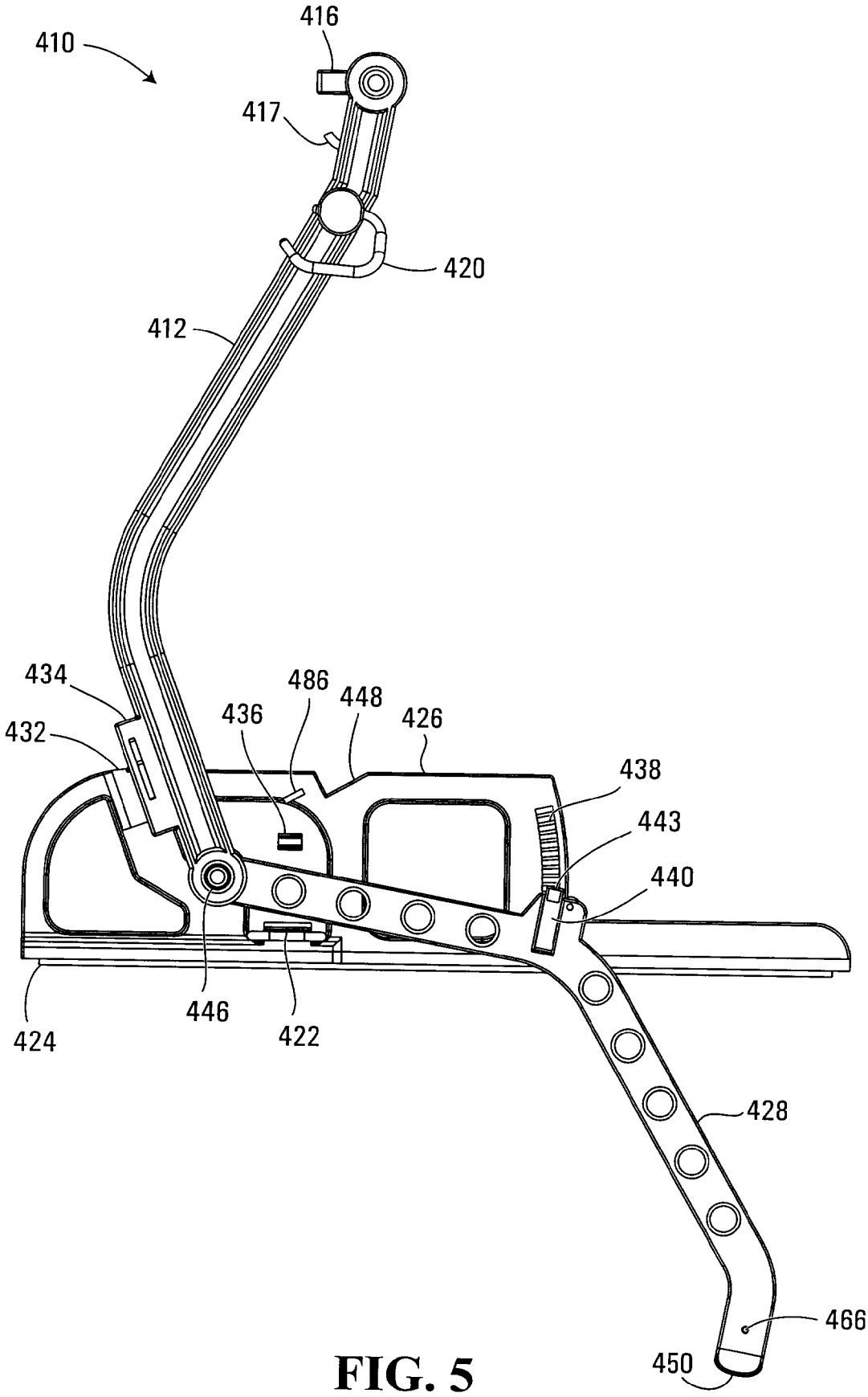
FIG. 5 is a side view of the embodiment of FIG. 4 in which a lower roller handle hook is in an extended position.

Referring now to FIG. 3, a support 300 for use on an uneven surface comprises a support tray 310 and at least one leg 320 pivotally coupled to the support tray 310. The at least one leg 320 is selectively positionable for fixing the angular orientation of the at least one leg 320 relative to the support tray 310. Each leg 320 comprises an arm portion 324 pivotally connected to the support tray 310 and a surface engaging portion 326 extending at an angle from the arm portion 324. In use, the arm portion 324 remains above a bottom surface of the support tray 310 when the surface engaging portion 326 engages the uneven surface.

In some embodiments of the support 300, the uneven surface is stairs having an upper stair and a lower stair. In these cases, the at least one leg 320 is curved and sized such that when the support tray 310 is placed on the upper stair, the at least one leg 320 contacts the stairs only with free ends on the lower stair. In some embodiments, the legs 320 are sized to fit at least two different stair sizes. In some embodiments, they are sized to fit at least 7, 8 and 9 inch stairs.

In some embodiments, the at least one leg 320 is pivotally coupled to the support tray 310 towards a supported end of the support tray 310.

Referring to FIGS. 4 to 10, a specific embodiment of the present invention is a holder 410 for a paint container such as a paint tray or paint can according to an embodiment of the present invention comprises a support base 424 with support sides 426. A lifting member 411 is comprised of handle arms 412 pivotally attached to the support sides 426 and a handle crosspiece 414 interconnecting handle arms 412 at a pivot point 446. Legs 428 are pivotally connected to the support sides 426 by the same pivotal connection 445 as the handle arms 412. A ratchet 440 is provided on each of the legs 428 and co-operating ratchet notches 438 are provided on the support sides 426 which enable selective angular positioning of the legs 428 relative to the support base 424

The lifting member is movable between an upright position and a folded storage position. In the upright position, the crosspiece 414 extends substantially over the combined centre of gravity of the holder 410 and the paint container.

The legs 28 are curved upward so that when the holder 410 is placed on an upper stair, the legs 428 contact the stairs only with feet 50, on free ends of the legs 428, which rest on a lower stair. For use on level surfaces, the legs 428 can be pivoted upward to rest against the lifting member. The handle arms 412 and the legs 428 are attached to the support sides 426 towards the rear of the holder 410 and are curved rearwardly from the attachment point to minimize interference with painting.

In greater detail, the holder 410 has the support base 424 which has can depressions 460. The can depressions 460 are preferably centred between the lateral sides of the support base 424. Longitudinally, the can depressions 460 are centred over the centre of gravity of the holder 410. The can depressions 460 of the embodiment shown allow two different can sizes to be accommodated. It is to be understood that in other embodiments more or less sizes are accommodated. The can depressions 460 are stepwise depressions each of which results in a circumferential lip which inhibits sliding of a can on the support base 424.

The support base 424 also has front projections 462 and rear projections 464. The front and rear projections 462, 464 are provided to accommodate varying sizes of paint trays. The front and rear projections 462, 464 centre the paint tray laterally and position the paint tray longitudinally with the combined centre of gravity of the paint tray and holder 10 under the crosspiece 414. Like the can depressions 60, the front and rear projections 462, 464 inhibit sliding of a paint tray on the support base 424. The support base 424 also has a front lip 458 and a rear lip 456 which inhibit articles from sliding off of the support base 424.

Figure 6:
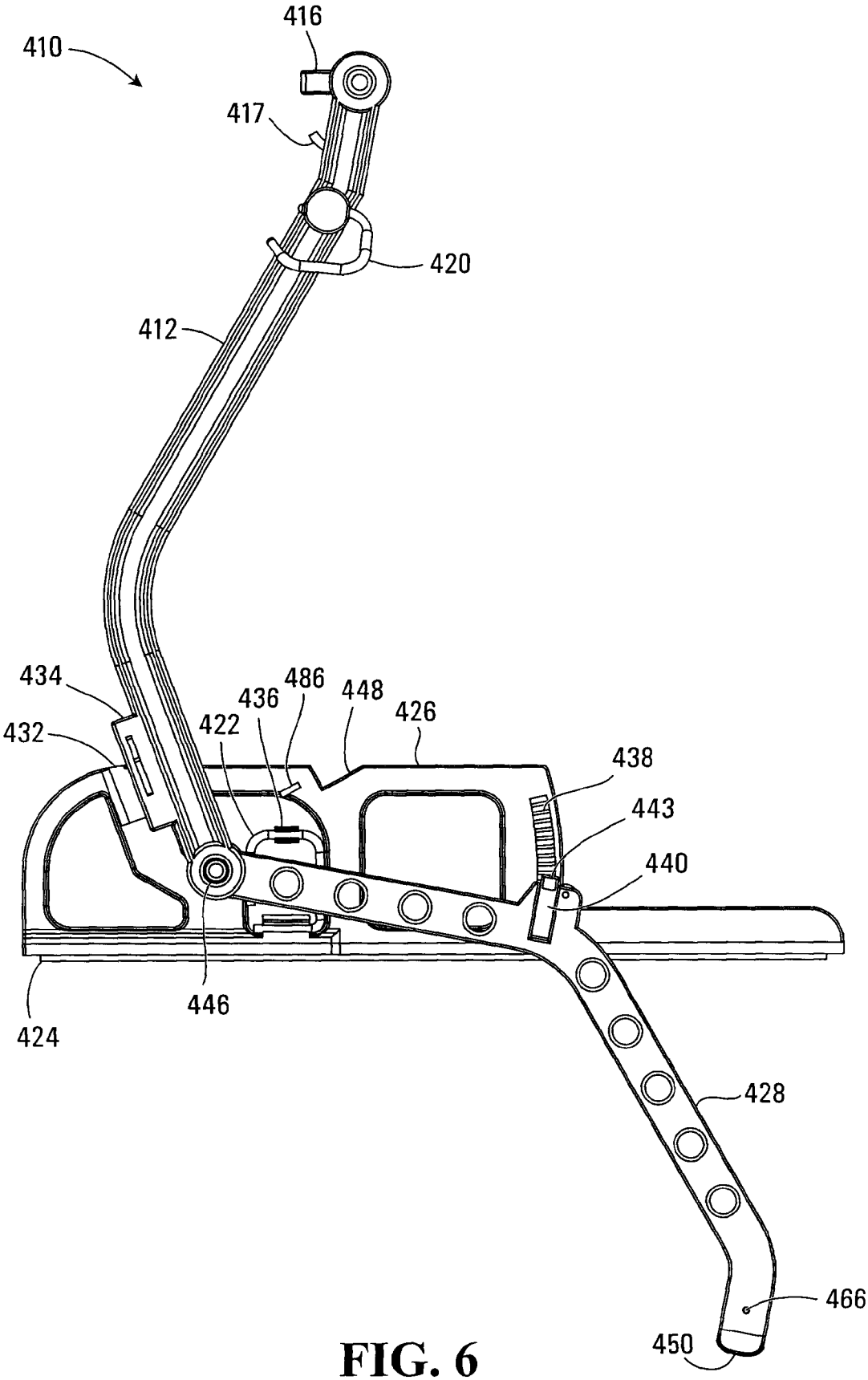
FIG. 6 is a side view of the embodiment of FIG. 4 with the lower roller handle hook in a stowed position.
Figure 7:
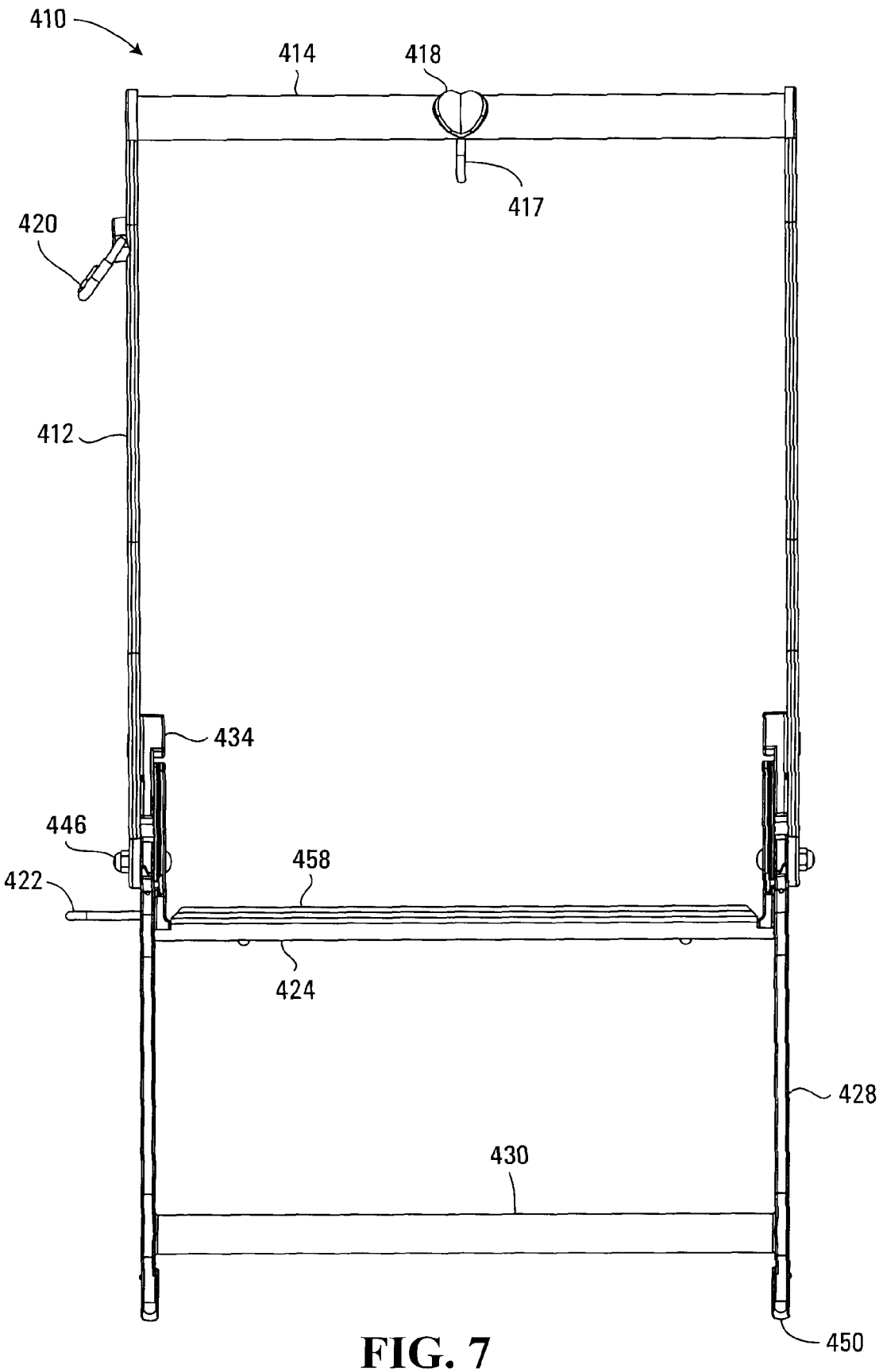
FIG. 7 is a front view of the embodiment of FIG. 4.
Figure 8:
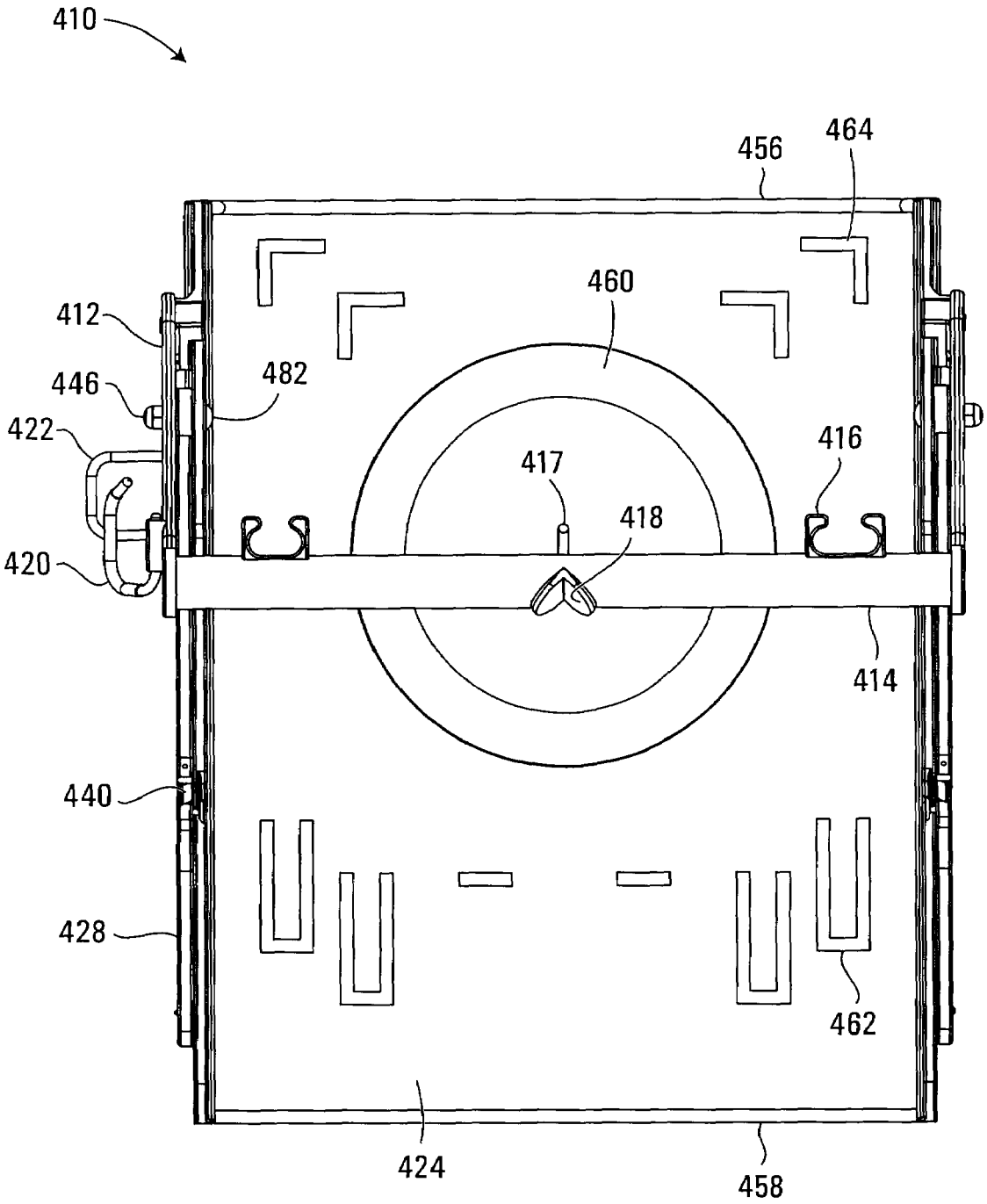
FIG. 8 is a top view of the embodiment of FIG. 4.
Figure 9:
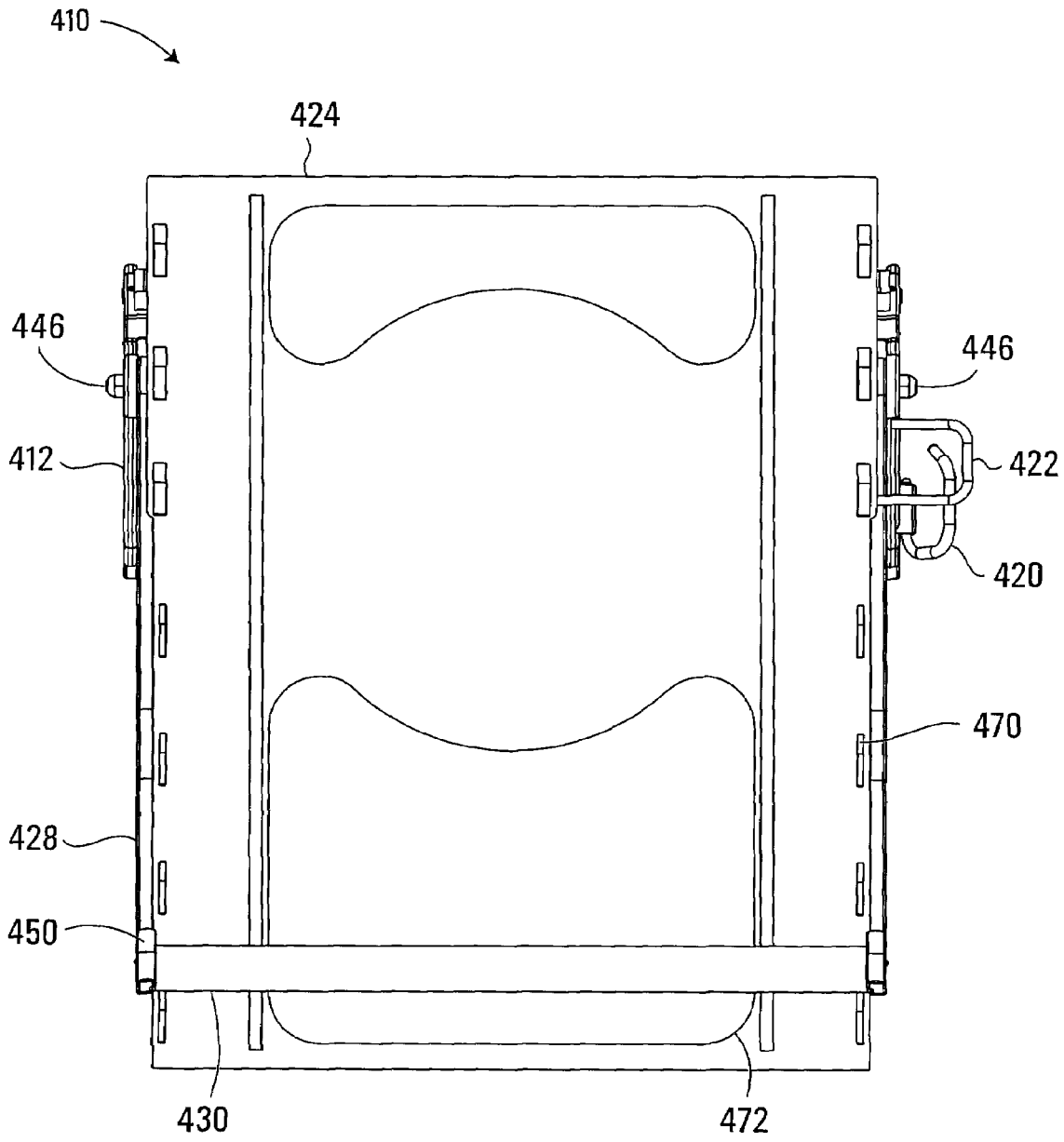
FIG. 9 is a bottom view of the embodiment of FIG. 4.

The two lateral or support sides 426 are connected to the support base 424 along the lateral edges of the support base 424. The attachment mechanism for the support sides 426 to the support base 424 is shown in FIGS. 6 and 8. Each of the support sides 426 has a plurality of protrusions 470 extending downward from the sides 426. The support base 424 has a plurality of holes 484 aligned with the protrusions 470. The protrusions 470 snap into the holes 84 to retain the support sides 426 on the support base 424.

The lifting member, which is comprised of the elongated handle arms 412 and the handle crosspiece 414, and the legs 428 are pivotally connected to the sides 426 as noted above. The assembly of the handle arms 412 and the legs 428 to the support sides 426 can also be seen in FIG. 8. A shaft of a bolt 482 is extended through the sides 426 with the head of the bolt 482 resting against an inner surface of the sides 426. The shaft of the bolt then extends through a leg 428 and then through one of the handle arms 412. A washer 452 is placed and then a nut 446 is threaded over the bolt 482 to retain the assembly together.

The handle crosspiece 414 of this embodiment has several adaptations to aid the painter. First, a roller handle rest 18 is provided on the front side of the handle crosspiece 414. The roller handle rest 418 is V-shaped to prevent a roller handle lodged in the roller handle rest 418 from slipping sideways. Two paint brush clips 416 are provided at opposite ends of the handle crosspiece 414. A paint brush can be clipped into either of these paint brush clips 416 when the paint brush is not in use. Finally, a utility hook extends downwardly and rearwardly from the centre of the handle crosspiece 414. The hook is for hanging a paint can on if the tray is used on a surface where the tray can not be leveled or the paint can cannot be secured.

Two other hooks are provided in the assembly for holding a paint roller. An upper roller handle hook 420 is attached towards the top of one of the handle arms 412. A lower roller handle hook 422 is attached to one of the support sides 426 below the upper roller handle hook 420. The upper roller handle hook 420 is pivotally attached to the handle arm 412 by a connector 421. The connector 421 could alternatively be integrally molded. The upper roller handle hook 420 is shown hanging downwardly in FIGS. 4 to 11. In use, the upper handle hook 420 is pivoted to a substantially horizontal position and a paint roller handle is extended through the upper roller handle hook 420. The lower roller handle hook 422 is pivotally connected to the support sides 426. In FIGS. 1 and 2, the lower roller handle hook 422 is shown extending outwardly substantially horizontally in its use position. The lower roller handle hook 422 is substantially in alignment with the upper roller handle hook 420 such that in use a paint roller handle can be extended through both hooks 420 and 422 and thereby held in a substantially vertical position with a lower end resting against a support surface. In FIG. 3, the lower roller handle hook 422 is shown in its storage position. A retaining clip 436 is mounted to the side of the support sides 426. The top of the loop of the lower roller handle hook 422 is snapped in place and retained by the retaining clip 436.

In FIGS. 4 to 10, the leg assembly is shown in a position for use on stairs or sloped surfaces. Each leg 428 has an arm portion 427 attached to the pivot point and a surface or step engaging portion 429 extending from the arm portion as seen in these figures. A ratchet 440 is provided on each of the legs 428 intermediate these two portions. The ratchet is fastened to the leg as shown in FIG. 8. In particular, the ratchet 440 is positioned in a receiving space in the leg 428 and pin 480 is inserted through the ratchet 440 to hold it in place. An inner face of the ratchet 440 has ratchet protrusions 441 (see FIG. 11) and an outer face of the ratchet 440 has ratchet releases 443. The ratchet protrusions 441 are aligned to mate with the ratchet notches 438 which form a vertically extending arc along the outer surface of the sides 426. The ratchets 440 are biased such that the ratchet protrusions 441 remain pressed against the ratchet notches 438 unless the ratchet releases 443 are depressed on both ratchets 440. The ratchets 440 in co-operation with the ratchet notches 438 on the support sides 426 allow the legs 428 to be held in a fixed position relative to the support sides 426.

To ensure that contact is maintained between the ratchet protrusions 441 and the ratchet notches 438, each leg 428 is provided with a button ratchet retainer 442. The ratchet retainer 442 extends inwardly from the leg 428 adjacent the ratchet 440. A head of each ratchet retainer 442 holds a thin edge 444 of each support side 426 between each leg 428 and the ratchet retainer 442. This maintains the legs 428 against the support sides 426 as the ratchet moves the legs 428 upward and downward relative to the support sides 426 by depression of the ratchet releases 443 and rotation of the legs 428 about their pivot point 445. The horizontally extending portion arm portion 427 of the legs 428 remains substantially above the bottom surface of the support base 424 throughout the range of travel of ratchet 440 on ratchet notches 438.

The legs 428 are interconnected by a cross brace 430. The cross brace 430 ensures that the legs 428 are retained in the same relative positions with respect to the support sides 426. The feet 450 are provided at the bottom of the legs 428. The feet 450 are preferably rubber or other similar material to prevent damage of the resting surface and to prevent slippage.

A plurality of holes are defined through the legs 428. These holes are provided simply to reduce material to minimize the weight of the holder 410. Similarly, cut-out areas 472 and 473 can be seen on the bottom of the support base 424 and support sides 426. These areas have a thinner material thickness to reduce the overall weight of the holder without compromising structural strength.

Figure 10:
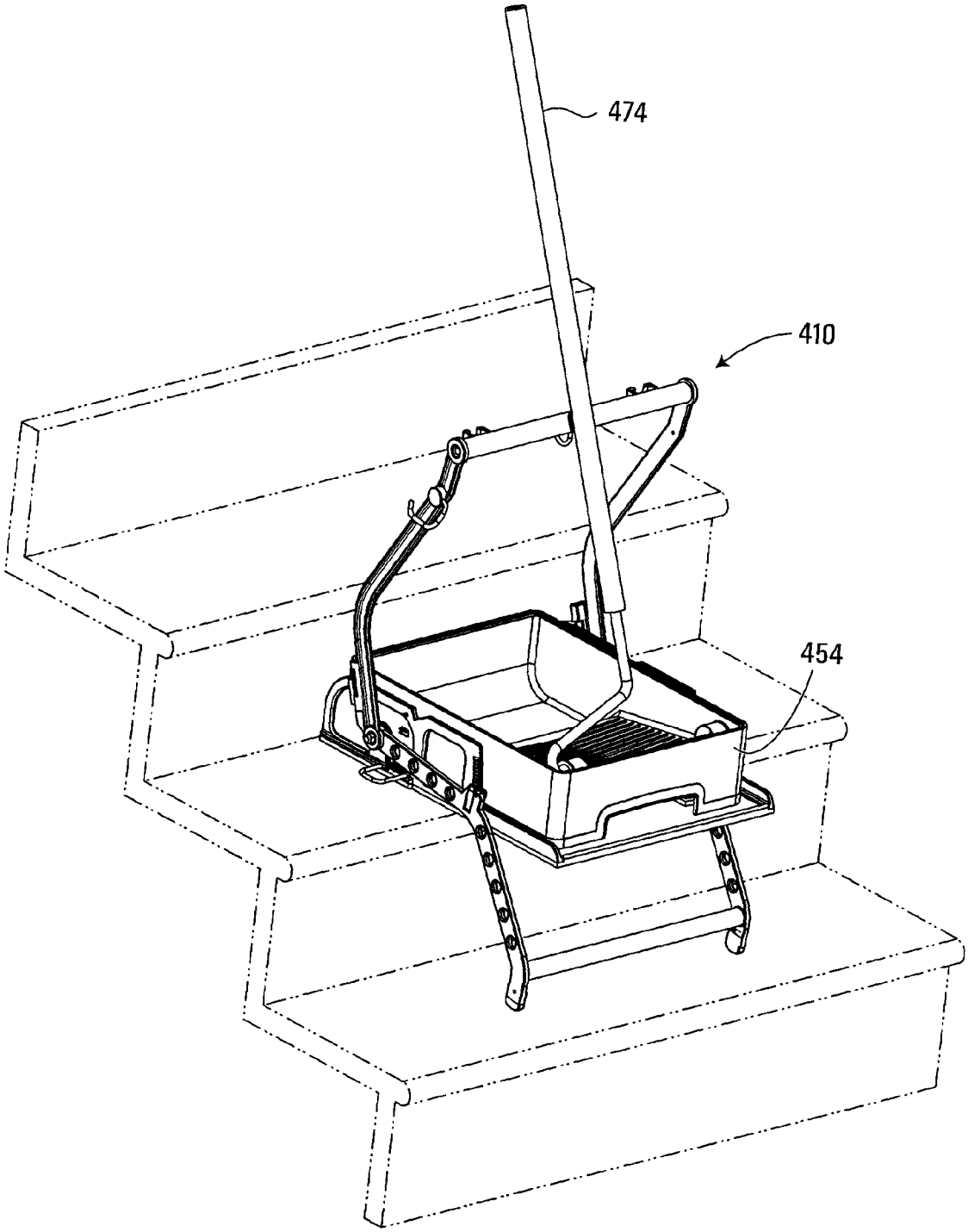
FIG. 10 is a perspective view of the embodiment of FIG. 4 in use upon stairs with a roller.
Figure 11:
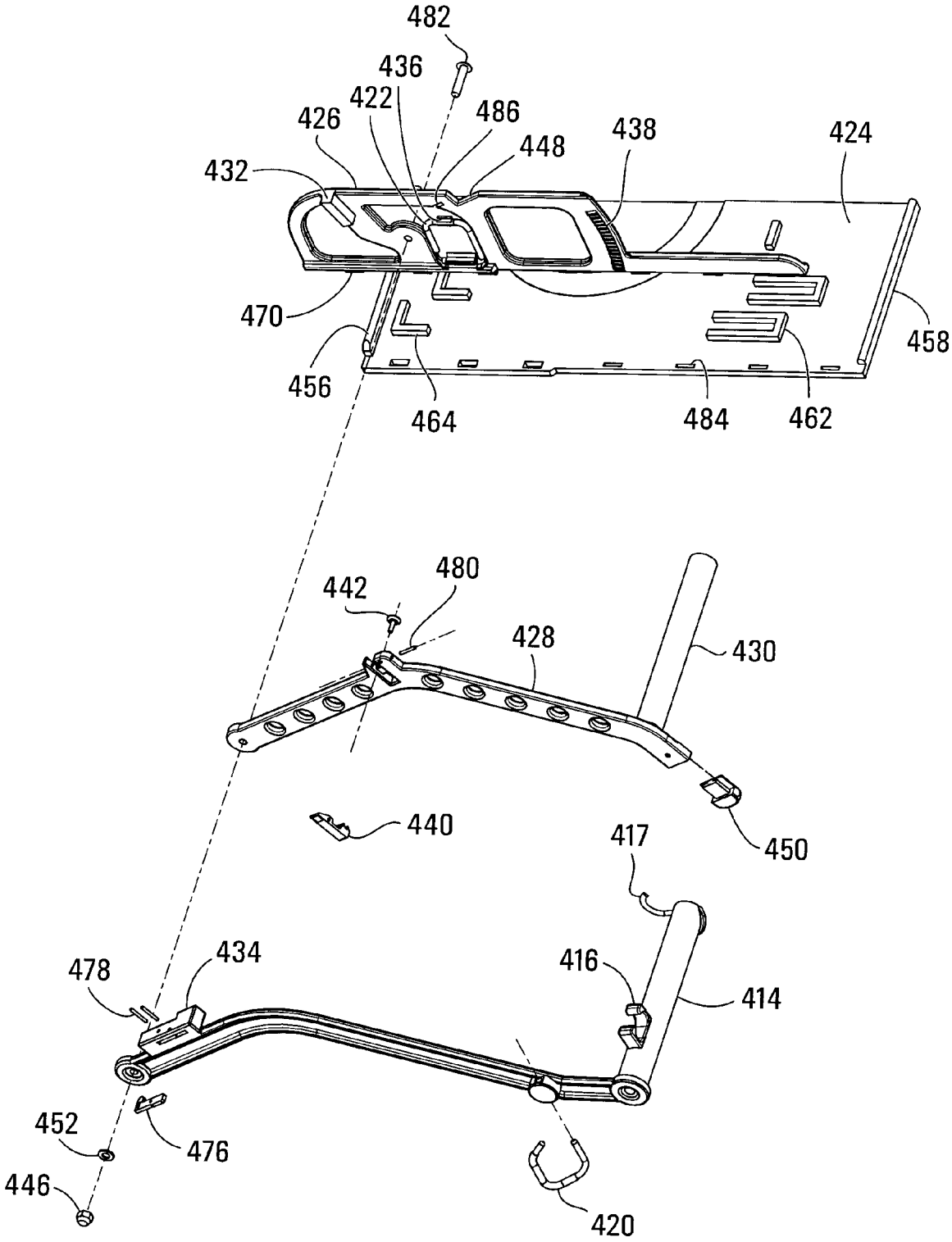
FIG. 11 is an exploded perspective view of a portion of a handle, a leg, a side and a bottom of the holder of the embodiment of FIG. 4.

The handle arms 412 are shown in FIGS. 4 to 11 in the upright position. At the bottom of each handle arm 412 is an arm block 434. Each of the support sides 426 is provided with an armrest 432. In the upright position, the arm block 434 of each handle arm 432 rests against the respective armrest 32 to hold the handle arms 412 in an upright position. As can be seen in FIG. 11, a leaf spring 476 is provided in each arm block 434 and retained in position with pins 478. The leaf springs 476 are spring loaded. Support sides 426 have notches 48 to accommodate the arm blocks 434 when the handle arms 412 are in the folded position. Slots 486 are provided through the support sides 426 which are positioned to accommodate the leaf springs 476 when the handle arms 412 are in the folded position.

FIG. 10 shows the holder 410 in use on a set of stairs. The support base 424 rests on an upper stair. The legs 428 are adjusted to an appropriate height by rotating the legs to allow the feet 450 of the legs 428 to rest upon a lower stair. The ratchet releases 443 do not require depression when the legs 428 are rotated downwards. The design of the ratchet assembly allows the legs 428 to rotate downwards and will lock at the position where rotation is stopped. The user would, for example, set the holder 410 on a stair, or other uneven surface or surface that is not level, and rotate the legs 428 until the feet 450 contact the lower stair or ground. The ratchet releases 43 would automatically latch in this position keeping the holder 410 level. Depression of the ratchet releases 443 is only required to retract the legs 428 to the storage position.

The shape of the legs 428 ensures that the legs 428 contact the lower stair only with the feet 450. The ratchet releases 443 are then released and the ratchet 440 retains the relative position of the support base 424 and the legs 428. The legs 428 can be positioned by moving the ratchet 440 upwards or downwards along the ratchet notches 438 to accommodate a variety of step heights including 7, 8 and 9 inch steps.

If the holder 10 is alternatively used on a sloped surface such as a rooftop, the set-up of the holder 10 is the same. However, only a rear edge of the support base 424 rests on the rooftop. The remainder of the support base 424 is suspended and supported by the rear edge and by the legs 428. The rear edge of the support base 424 has an integral rubber foot (not shown) that prevents the device from sliding and eliminates any marking or damage if the holder 410 is placed on a delicate surface.

As can been seen in FIG. 10, paint tray 454 is positioned on the holder 410. A paint roller 474 rests in the roller handle rest 418 when not in use. When in use, the roller is rolled downwards towards the rear of the holder 410 and then lifted out of the paint tray 454 laterally for painting. The handle arms 412 are angled rearwardly and then upwardly at an angle so that the paint roller can be lifted sideways out of the paint tray without the handle arms interfering with the movement of the paint roller. The angle of the handle arms 412 can best be seen from FIGS. 5 and 6. The handle crosspiece 414 is positioned substantially over the centre of gravity of the holder and paint tray or other paint container assembly. This helps to maintain the paint tray in a horizontal position when the handle arms 412 is used to lift the holder.

The handle arms 412 extend significantly upward so that the painter can lift and move the holder without undue bending.

Figure 12:
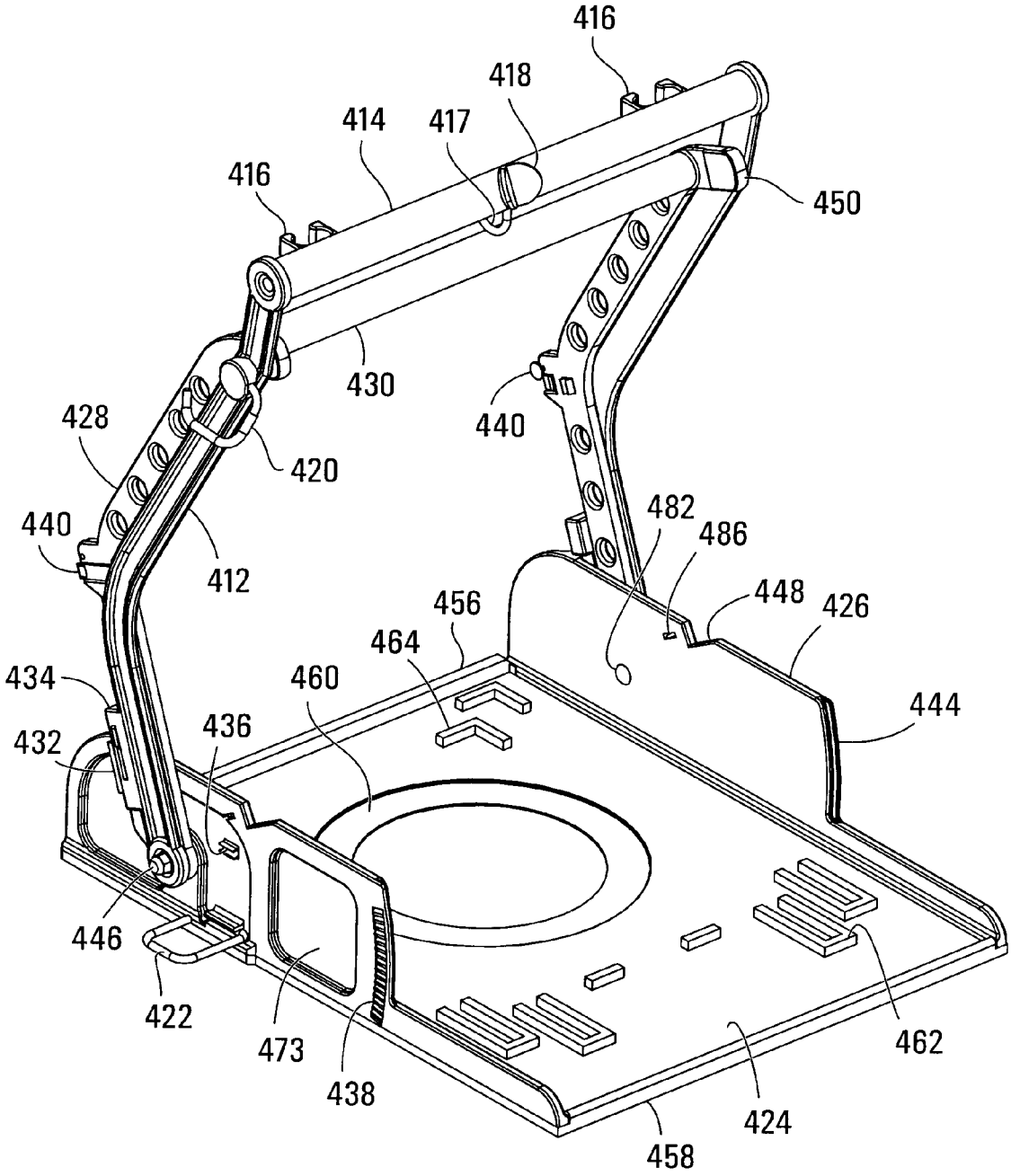
FIG. 12 is a perspective view of the holder of FIG. 4 in a position for use on a level surface.
Figure 13:
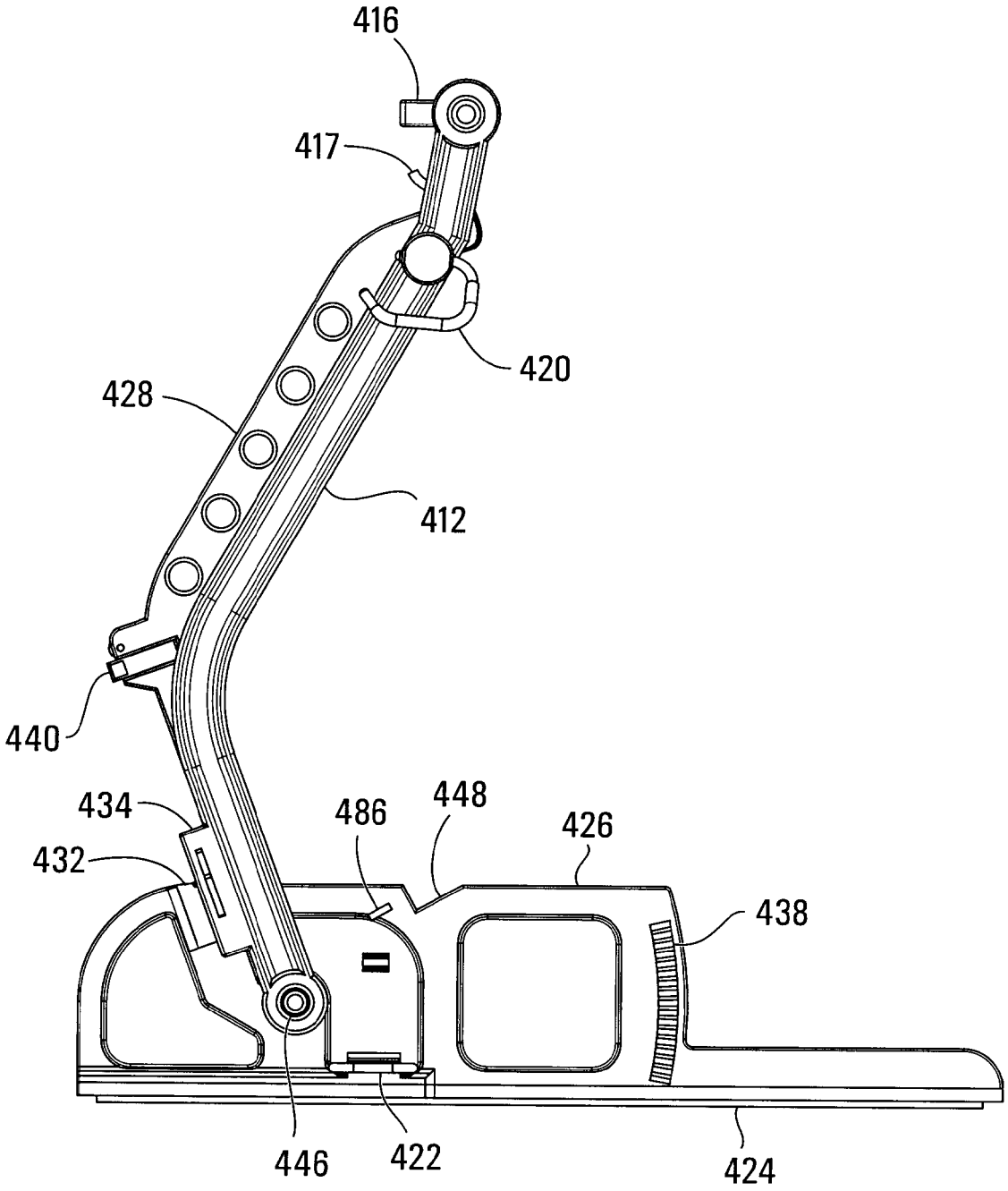
FIG. 13 is a side view of the embodiment of FIG. 12.
Figure 14:
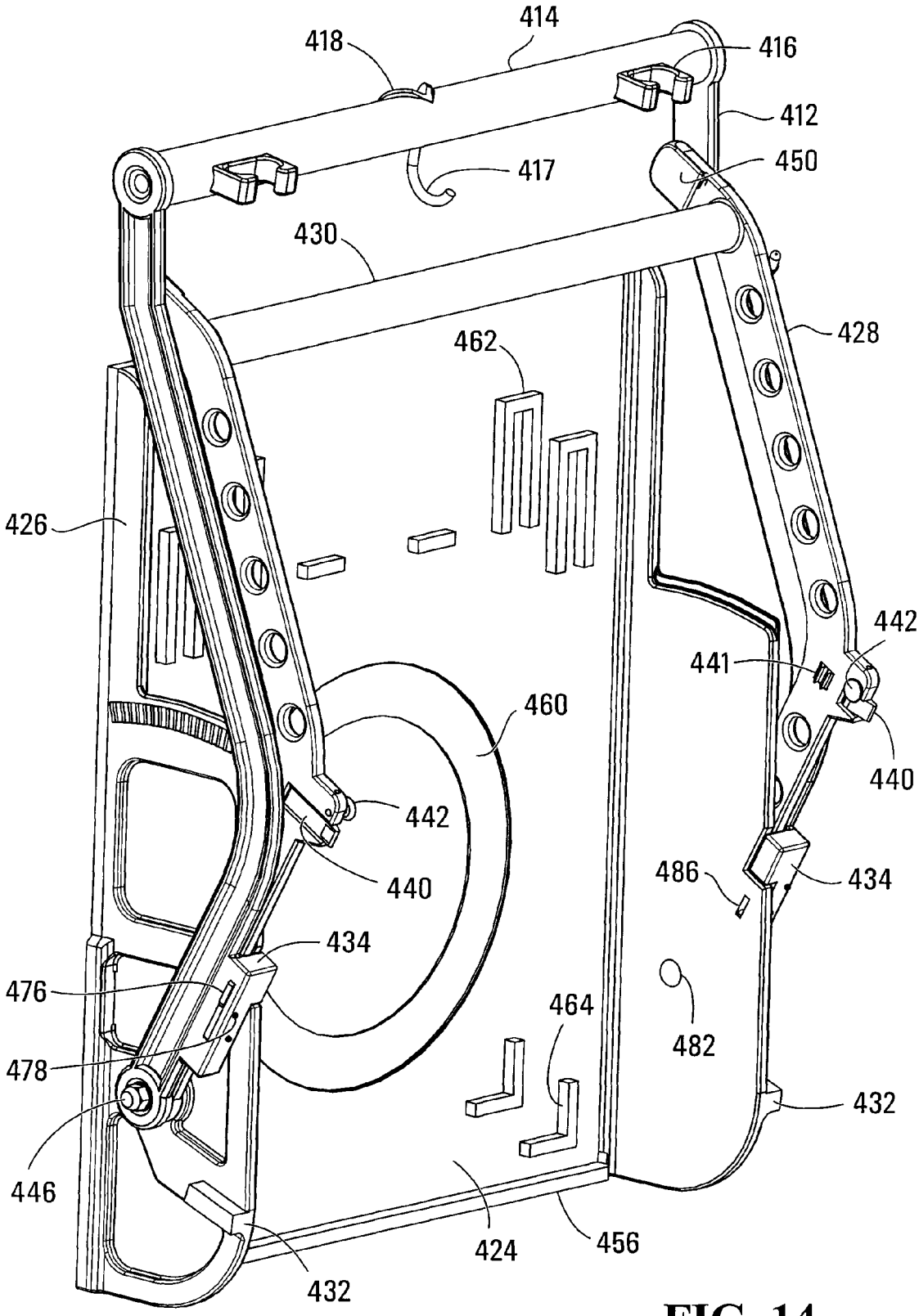
FIG. 14 is a perspective view of the embodiment of FIG. 4 in a folded position for storage.
Figure 15:
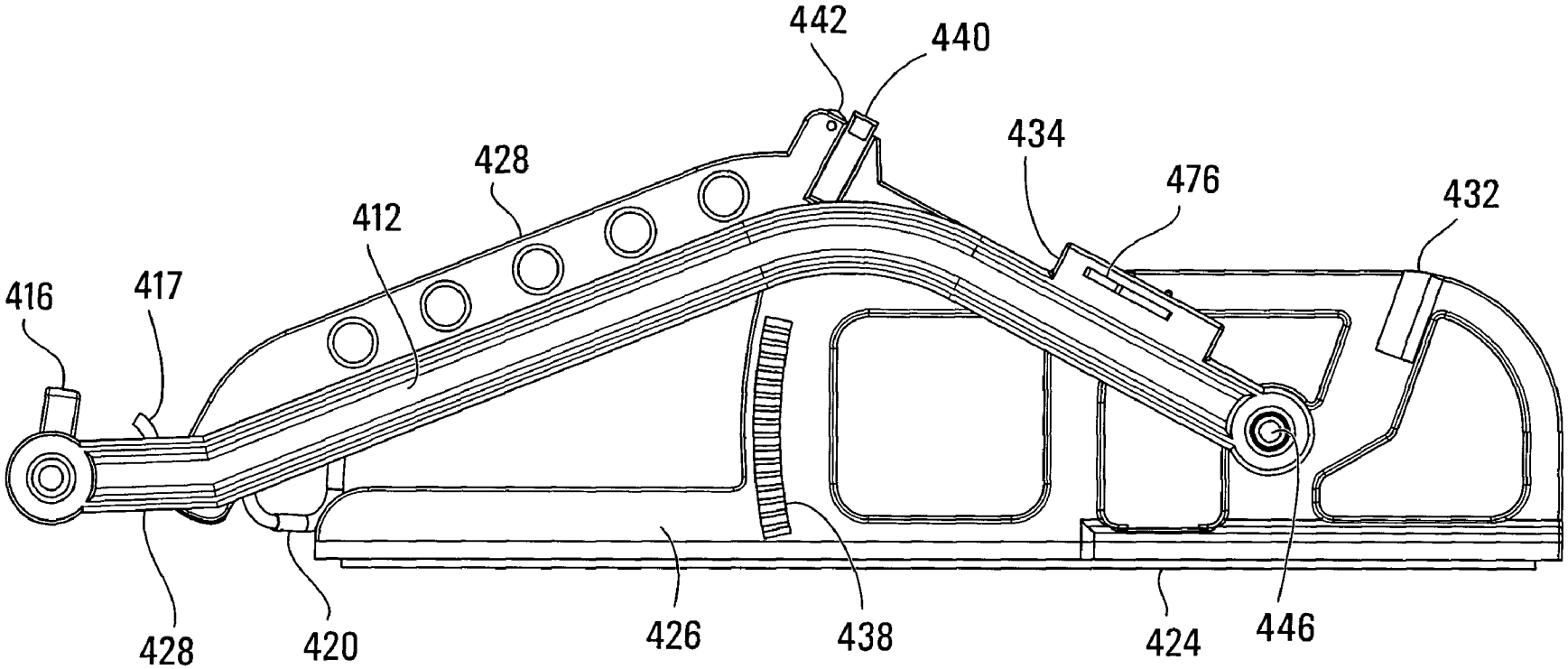
FIG. 15 is a side view of the embodiment of FIG. 14.
Figure 16:
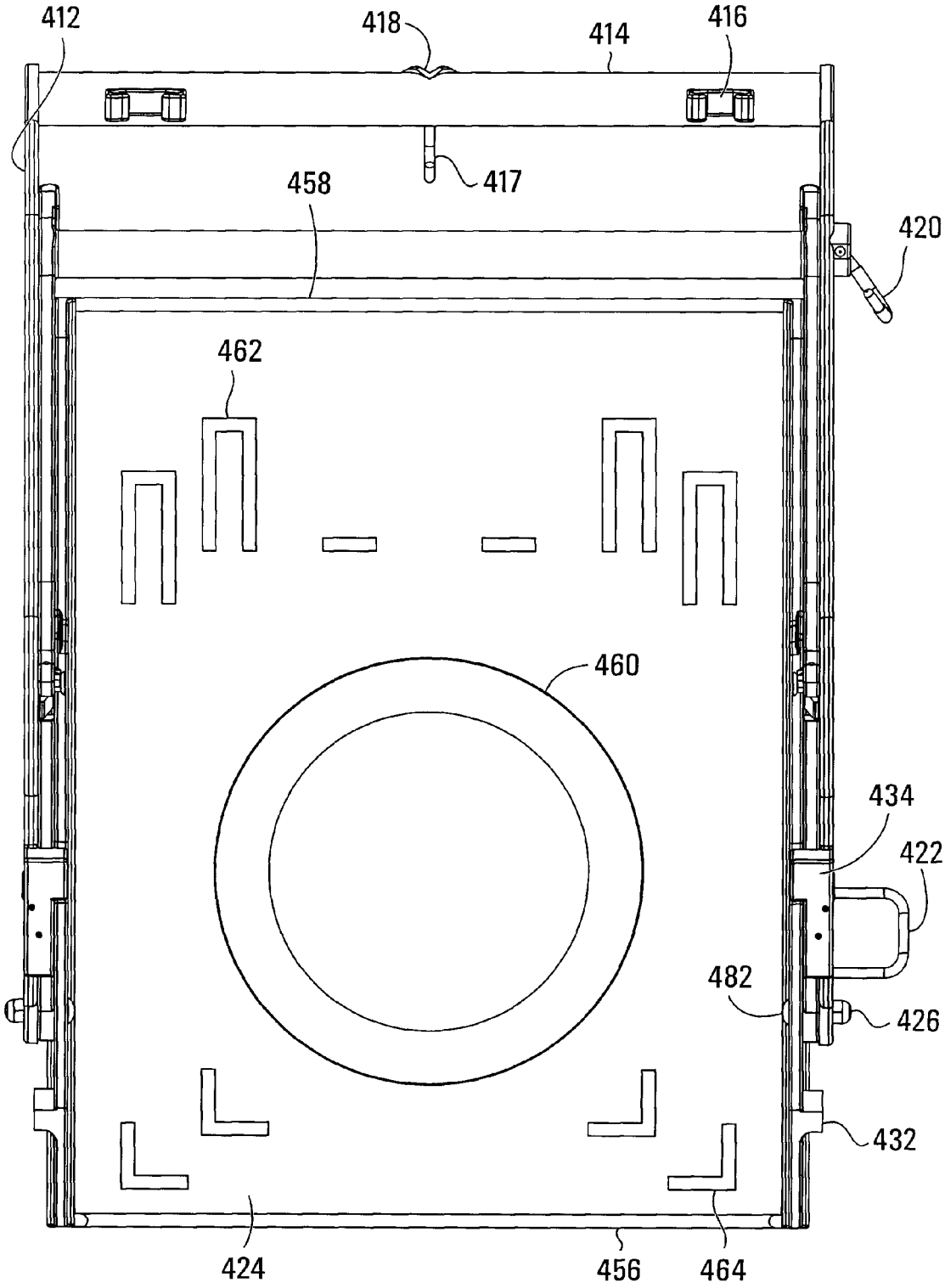
FIG. 16 is a top view of the embodiment of FIG. 14.
Figure 17:
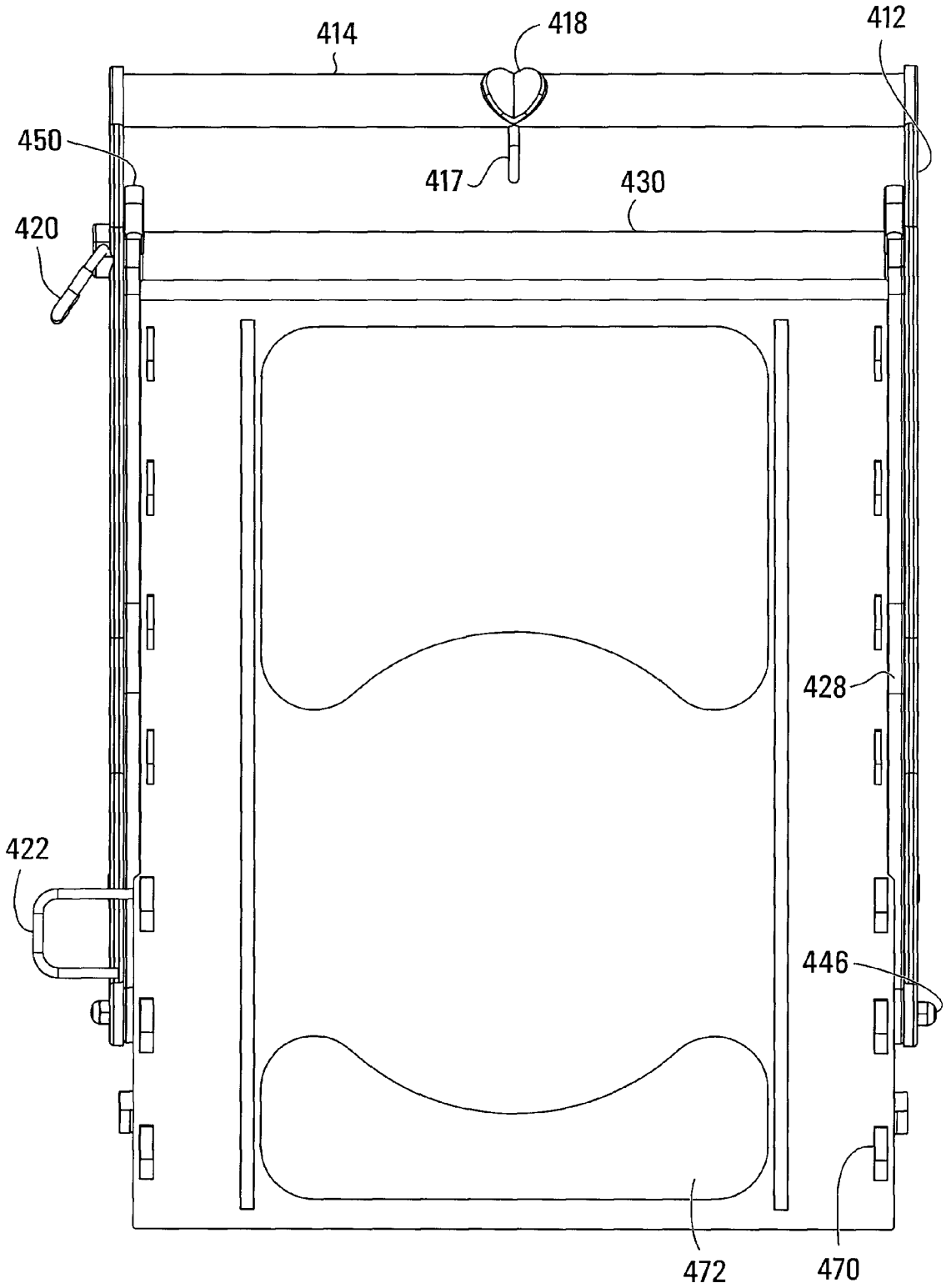
FIG. 17 is a bottom view of the embodiment of FIG. 14.

FIGS. 12 and 13 show the holder 410 configured for use on a level surface. In these figures, the legs 428 have been rotated to rest in alignment with the handle arms 412. The alignment of the legs 428 with the handle arms 412 is retained by two means. First, the legs 428 rest against a portion of the arm blocks 434 which extend over the support sides 426. Second, the legs 428 each have a detent 466 and the handle arms 412 each have detent holes 468. When the legs 428 are rotated into alignment with the handle arms 412, the detents 466 spring into the detent holes 468 to aid in retaining alignment. The detents 466 and the detent holes 468 are spherical so that the legs 28 may be pulled out of alignment with the handle arms 412 by pivoting the legs 428 forward.

As can be clearly seen from FIGS. 12 and 13, the shape of the handle arms 412 and the legs 428 are substantially the same. Thus, when the legs 428 are folded for use of the holder 410 on a level surface, the legs 428 do not interfere with the movement of the paint roller as described above. The angle of the legs 428 is substantially defined by standard stair depths and heights. The contour of the handle arms 412, in particular the location of the angle turn in the arms 412, is substantially dictated by the shape of the legs 428.

The embodiment depicted in FIGS. 4 to 13 is intended to fit standard stair geometry. There are standard minimum dimensions for stair tread width and maximum for rise height. The stair tread typically must be at least 6.5" in width (8" is common) and have a maximum rise of 11" (8" is common although slightly higher in some basement stairs.

The particular angles and dimensions are dictated by the stair geometry and the location of the rotational point on the side 426 of the holder 410. If this rotational point were relocated then the angles and dimensions would also change.

The configuration of the embodiment depicted in FIGS. 4 to 11 maintains the pivot point close to the centre of gravity but other pivot points could be used although materials stress would increase and require an additional material thickness or a stronger material.

Turning to FIGS. 14 to 17, the holder 410 is shown in a folded position for storage. In this position, the longitudinal axis of the handle arms 412 and the legs 428 is coextensive with the longitudinal axis of the support base 424. As can be best seen in FIG. 11, in the folded position, the handle arms 412 and the legs 428 are pivoted until the arm block 434 rests in notches 448 defined in the support sides 426. In this position, the leaf springs 476 of the blocks 434 spring into the slots 486 to retain the handle arms 412 in the stored position. The legs 428 are maintained in their position relative to the handle arms 412 as in the previous case by the co-operation of the detents 466 and the detent holes 68.

Numerous modifications and variations of embodiments of the present invention are possible in light of the above teachings.

Although it is preferable that both the handle arms 412 and the legs 428 be attached at the same pivot point and have a similar shape, they may alternatively be attached at different pivot points and have varying shapes. The shape of the legs 428 and the arms 412 shown may be varied, for example being completely arched or having a plurality of segments. The crosspiece 414 may extend at locations other than the centre of gravity of the holder 410. The lifting member may be formed with only one arm 412 and the legs 428 may be replaced with one leg with the feet 450 attached to the cross brace 430.

The figures depict a rectangular support base. However, it will be understood that the support base and sides may be comprised of a frame of members which serve to interconnect the handle and the legs and attach them to the paint container. Alternatively, the support base may be eliminated and the legs and handle may be directly connected to the paint container.

It is to be understood that within the scope of the appended claims, the invention may be practiced otherwise than as specifically described herein.

The invention claimed is:

1. A support for use on an uneven surface comprising:
a support tray;
at least one leg pivotally coupled to the support tray and selectively positionable for fixing the angular orientation of the at least one leg relative to the support tray;
a retaining mechanism for maintaining the angular orientation of the at least one leg relative to the support tray while the support is in use;
each leg comprising an arm portion pivotally connected to the support tray and a surface engaging portion extending at an angle from the arm portion;
wherein:
in use, the arm portion remains at or above a bottom surface of the support tray when the surface engaging portion engages the uneven surface;
the support tray has sides, a front, a rear, and a midpoint, the midpoint being midway between the front and the rear;
the uneven surface is a staircase having an upper stair and a lower stair;
a portion of the support tray towards the rear rests on the upper stair;
the at least one leg being pivotally coupled to a side of the support tray between the rear of the support tray and the midpoint and the at least one leg being selectively positionable for fixing free ends of the at least one leg relative to the support tray; and
the at least one leg being curved and sized such that when the support tray is placed on the upper stair, the at least one leg contacts the staircase only with the free ends on the lower stair.

2. The support according to claim 1, wherein the at least one leg is pivotally coupled to the support tray at at least one first pivot point and the support further comprises a lifting member pivotally coupled to the support tray at at least one second pivot point.

3. The support according to claim 2, wherein the at least one first pivot point and the at least one second pivot point are colocated.

4. The support according to claim 2, wherein the lifting member moves about the at least one second pivot point independently of the at least one leg.

5. The support according to claim 2 wherein the lifting member is movable between an upright position and a folded position.

6. The support according to claim 5 wherein the at least one leg is positionable at least in substantial alignment with the upright position of the lifting member and the folded position of the lifting member.

7. The support according to claim 6 wherein the support tray has a planar support surface which has a longitudinal axis perpendicular to an axis about which the at least one leg pivots relative to the support tray; wherein the lifting member comprises at least one arm; and wherein the at least one arm and the at least one leg are in substantial alignment with the longitudinal axis of the planar support surface in the folded position of the lifting member.

8. The support according to claim 5, wherein the upright position of the lifting member is a locked position.

9. The support according to claim 2 wherein the support tray has a planar support surface which has a lateral axis parallel to an axis about which the at least one leg pivots relative to the support tray; wherein the support tray has a portion for accommodating a paint container comprising at least one of depressions or projections; wherein the lifting member comprises at least one arm and a crosspiece; wherein the at least one arm is joined to the crosspiece substantially parallel to the lateral axis of the planar support surface; and wherein, when the lifting member is in an upright position, the crosspiece extends substantially across a combined center of gravity of the paint container and the support tray when the paint container is located on the portion for accommodating a paint container.

10. The support according to claim 2 wherein:

the support tray has a planar support surface which has a longitudinal axis perpendicular to an axis about which the at least one leg pivots relative to the support tray and a lateral axis parallel to the axis about which the at least one leg pivots relative to the support tray;

the support has a paint roller input direction substantially parallel with the longitudinal axis; and when the at least one leg and the lifting member are positioned in an upright position, the at least one leg and the lifting member are curved away from the paint roller input direction to substantially avoid interference withdrawal of the paint roller in a direction substantially parallel to the lateral axis.

11. The support according to claim 2 wherein the support tray has a portion for accommodating a paint container comprising at least one of depressions or projections, and wherein the lifting member is coupled to the support tray on opposite sides of the portion for accommodating a paint container along an axis about which the lifting member pivots relative to the support tray.

12. The support according to claim 2 wherein the lifting member comprises two arcuate arms joined by a crosspiece wherein the crosspiece is substantially parallel to an axis about which the lifting member pivots relative to the support tray.

13. The support according to claim 12 wherein the support tray has a portion for accommodating a paint container comprising at least one of depressions or projections, and wherein the two arcuate arms are coupled to the support tray on opposite sides of the portion for accommodating a paint container along the axis about which the lifting member pivots relative to the support tray.

14. The support according to claim 2, wherein the at least one second pivot point is located towards the rear, and the lifting member comprises at least one arm, wherein, when the lifting member is in an upright position, the at least one arm is angled rearwardly from the at least one second pivot point to substantially avoid interference withdrawal of a paint roller in a direction parallel to an axis about which the lifting member pivots relative to the support tray during use.

15. The support according to claim 1 wherein the at least one leg comprises two legs pivotally coupled to opposite sides of the support tray, respectively.

16. The support according to claim 1, wherein the at least one leg is pivotally coupled to the support tray towards an end of the support tray supported by the uneven surface.

17. The support according to claim 1 wherein the legs are sized to fit at least two different stair sizes.

18. The support according to claim 17 wherein the at least one leg is sized to fit at least 7, 8 and 9 inch stair heights.

19. The support according to claim 1, wherein the retaining mechanism comprises a ratchet.

* * * * *